US011577365B2

(12) United States Patent
Artz et al.

(10) Patent No.: US 11,577,365 B2
(45) Date of Patent: Feb. 14, 2023

(54) SYSTEMS AND METHODS OF PROCESSING A ROTATABLE ASSEMBLY

(71) Applicant: Honda Motor Co., Ltd., Tokyo (JP)

(72) Inventors: Spencer Artz, Ludlow Falls, OH (US); Michael Suber, Troy, OH (US)

( * ) Notice: Subject to any disclaimer, the term of this patent is extended or adjusted under 35 U.S.C. 154(b) by 872 days.

(21) Appl. No.: 16/376,055

(22) Filed: Apr. 5, 2019

(65) Prior Publication Data

US 2020/0316751 A1 Oct. 8, 2020

(51) Int. Cl.
*B24B 53/06* (2006.01)
*B24B 53/14* (2006.01)

(52) U.S. Cl.
CPC ..... *B24B 53/062* (2013.01); *B24B 53/14* (2013.01)

(58) Field of Classification Search
CPC ..... B24B 9/04; B24B 23/02; B24B 53/005; B24B 53/053; B24B 53/06; B24B 53/062; B24B 53/07; B24B 53/095; B24B 53/12; B24D 3/06; B24D 5/02; B24D 5/12; B24D 5/16
USPC ..... 451/5, 36, 56, 342, 358, 443, 460, 541
See application file for complete search history.

(56) References Cited

U.S. PATENT DOCUMENTS 3,812,626 A * 5/1974 Thompson ..... B24B 3/003 451/241
4,683,679 A * 8/1987 Salmon ..... B24B 45/00 451/72
4,821,460 A * 4/1989 Wegmann ..... B24B 47/20 73/660
5,163,250 A * 11/1992 Weber ..... B27B 5/325 451/352
5,259,914 A * 11/1993 Fisher ..... B24D 13/12 156/763
5,347,765 A * 9/1994 Mixon, Jr. ..... B23Q 3/12 451/442
5,601,483 A * 2/1997 Rudolf ..... B24B 23/022 451/344
5,957,752 A * 9/1999 Katakura ..... B24B 53/06 451/10
6,042,461 A * 3/2000 Pearson ..... B23D 45/042 451/353
6,267,647 B1 7/2001 Stocker et al.
6,719,619 B2 * 4/2004 Kuo ..... B24B 53/12 451/285

(Continued)

OTHER PUBLICATIONS

Hayes, Michael; "Reinventing the Wheels at Gleason Cutting Tools Corporation"; Gear Solutions; Jul. 2003; available at http://gearsolutions.com/features/reinventing-the-wheels-at-gleason-cutting-tools-corporation/ last visited Apr. 2, 2019; pp. 27-38.

*Primary Examiner* — Joel D Crandall
*Assistant Examiner* — Robert F Neibaur
(74) *Attorney, Agent, or Firm* — Armstrong Teasdale LLP

(57) ABSTRACT

A method of processing a rotatable assembly is described herein. The method includes mounting a grinding wheel on an arbor to form the rotatable assembly. The grinding wheel has a ring-structure formed from a plurality of grit particles dispersed within a metallic material. The method also includes mounting the rotatable assembly within at least one dressing machine, wherein the rotatable assembly is rotatable relative to a dressing tool within the at least one dressing machine, and shaping the grinding wheel with the dressing tool to define a final outer profile of the grinding wheel configured to machine a workpiece.

17 Claims, 6 Drawing Sheets

(56) References Cited

U.S. PATENT DOCUMENTS

| | | | | |
|---|---|---|---|---|
| 6,869,342 | B2 | 3/2005 | Stollberg | |
| 6,966,824 | B2 * | 11/2005 | Kotting | B24B 45/006 451/342 |
| 8,410,390 | B2 | 4/2013 | Altpeter et al. | |
| 8,512,098 | B1 * | 8/2013 | Bonner | B24D 7/18 451/48 |
| 8,590,523 | B2 | 11/2013 | O'Malley | |
| 8,784,155 | B2 * | 7/2014 | Guo | B23Q 1/626 451/5 |
| 8,920,211 | B2 * | 12/2014 | Wakazono | B24B 53/14 451/21 |
| 8,944,885 | B2 * | 2/2015 | Yanase | B23F 23/00 451/21 |
| 8,944,890 | B2 | 2/2015 | Ochi et al. | |
| 10,369,673 | B2 * | 8/2019 | Veittinger | B23Q 5/043 |
| 10,532,443 | B2 * | 1/2020 | Junker | B24B 49/006 |
| 10,556,318 | B2 * | 2/2020 | Yoshida | B24B 49/10 |
| 2009/0203296 | A1 * | 8/2009 | Braig | B24B 53/005 451/72 |
| 2014/0067321 | A1 * | 3/2014 | Zinngrebe | B24B 53/08 702/176 |
| 2018/0311789 | A1 * | 11/2018 | Barbosa De Oliveira Ferreira Salles | B24B 53/005 |

* cited by examiner

SYSTEMS AND METHODS OF PROCESSING A ROTATABLE ASSEMBLY

BACKGROUND

The present disclosure relates generally to systems and methods of machining metallic workpieces and, more specifically, to a metal-bonded grinding wheel and related methods of processing thereof.

Many known metallic workpieces have grooves or channels formed therein with a machining tool. The machining tool includes a rotatable shaft and a grinding wheel coupled to the shaft. At least some known grinding wheels are fabricated from a metallic substrate that is coated with a layer of abrasive material. For example, the metallic substrate may be initially coupled on a first shaft in a plating vessel to enable the layer of abrasive material to be cured on the surface of the metallic substrate. The grinding wheel is then uncoupled from the first shaft and coupled on a second shaft within a truing and dressing machine which shapes the grinding wheel to achieve a final profile in a precise and accurate manner. The grinding wheel is then uncoupled from the second shaft and coupled on an arbor in an arbor-mounting machine. The process of coupling and uncoupling the grinding wheel from the shafts within the different machines may be time-consuming, and any deformations or dimensional inaccuracies resulting therefrom facilitate increasing the likelihood of runout of the final rotating arbor-grinding wheel assembly. In addition, generally, known grinding wheels have a relatively short and limited lifespan, which also increases the cost and time needed to perform a machining operation.

BRIEF DESCRIPTION

In one aspect, a method of processing a rotatable assembly is provided. The method includes mounting a grinding wheel on an arbor to form the rotatable assembly. The grinding wheel includes a ring-structure formed from a plurality of grit particles dispersed within a metallic material. The method also includes mounting the rotatable assembly within at least one dressing machine, wherein the rotatable assembly is rotatable relative to a dressing tool within the at least one dressing machine, and shaping the grinding wheel with the dressing tool to define a final outer profile of the grinding wheel configured to machine a workpiece.

In another aspect, a method of processing a grinding wheel is provided. The method includes mounting a rotatable assembly within at least one dressing machine. The grinding wheel includes a ring-structure, wherein the rotatable assembly is rotatable relative to a dressing tool within the at least one dressing machine. The method also includes channeling a stream of fluid between the grinding wheel and the dressing tool, moving the dressing tool towards the grinding wheel, and using an acoustic sensor to determine when contact is achieved between the dressing tool and the grinding wheel.

In yet another aspect, a system for use in shaping a grinding wheel is provided. The system includes at least one dressing machine including a dressing tool, and a rotatable assembly mounted within the at least one dressing machine. The rotatable assembly includes an arbor, and a grinding wheel coupled to the arbor. The grinding wheel includes a ring-structure formed from a plurality of grit particles dispersed within a metallic material.

DETAILED DESCRIPTION

The embodiments described herein relate generally to metal-bonded grinding wheel and related methods of processing thereof. In one embodiment, the grinding wheel described herein is mounted on an arbor with a set of gears and bearings to form a dressing assembly. After mounted, the grinding wheel on the dressing assembly is dressed with the gears and bearings already installed to facilitate increasing the stability of the dressing assembly during the dressing processes. As a result, the surface finish of the grinding wheel is facilitated to be enhanced. The grinding wheel may then be removed from the dressing assembly and subsequently installed within a groove grinding machine.

In another embodiment, the grinding wheel described herein is mounted on an arbor to form a grinding assembly. After mounted, the grinding assembly is dressed (e.g., trued and conditioned) in different machines all while remaining mounted to the same arbor. Mounting the grinding wheel on the arbor prior to dressing facilitates reducing rotational runout as compared to known dressing processes that require the grinding wheel be coupled to, and uncoupled from, a variety of different shafts in different processing machines. Dressing the grinding wheel facilitates defining a final outer profile, such that the second grinding assembly is ready for immediate use when transferred as a unitary and fully-assembled structure. In addition, in either embodiment, the grinding wheel is a ring-structure formed from a plurality of grit particles dispersed within a volume of metallic material. As such, the grinding wheel may be reconditioned to facilitate increasing its useful service life.

Figure 1:
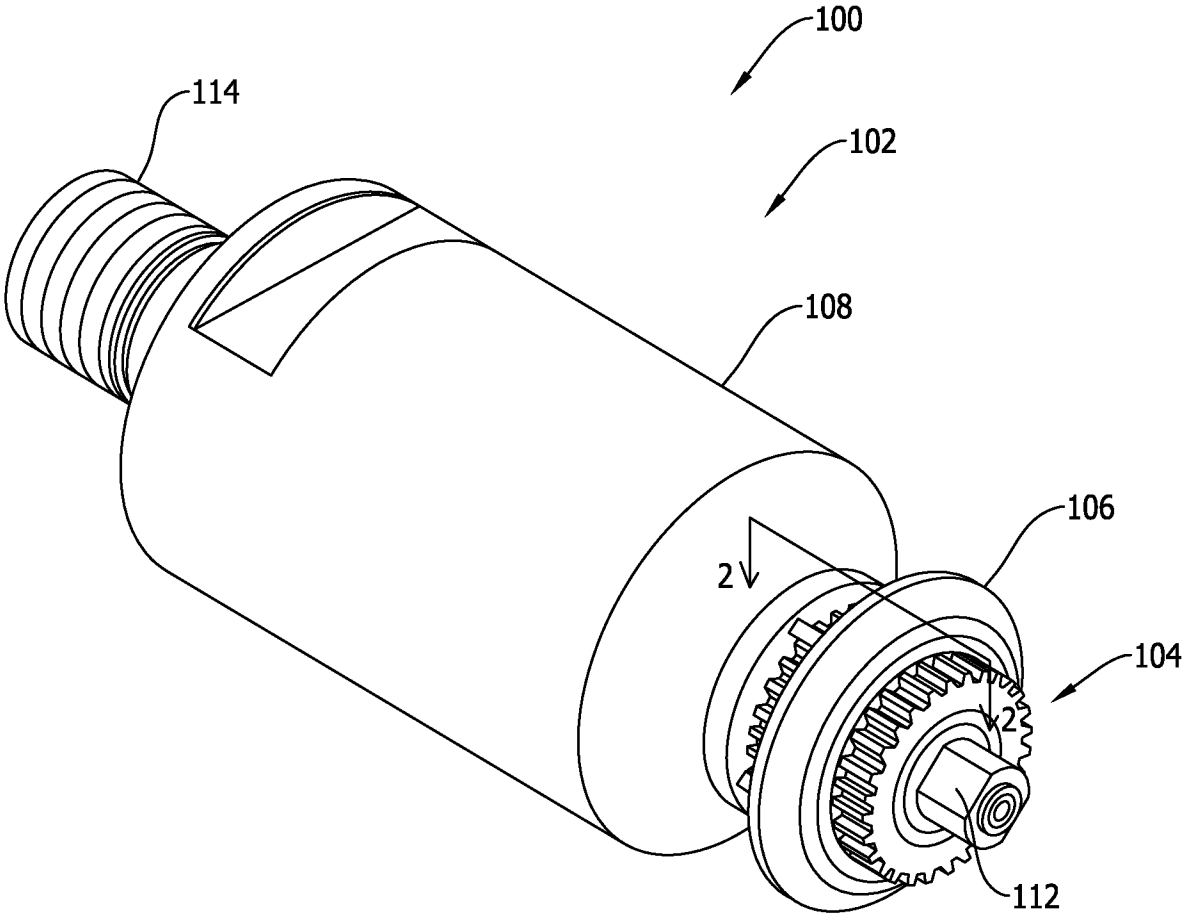
FIG. 1 is a perspective view of an exemplary dressing assembly.
Figure 2:
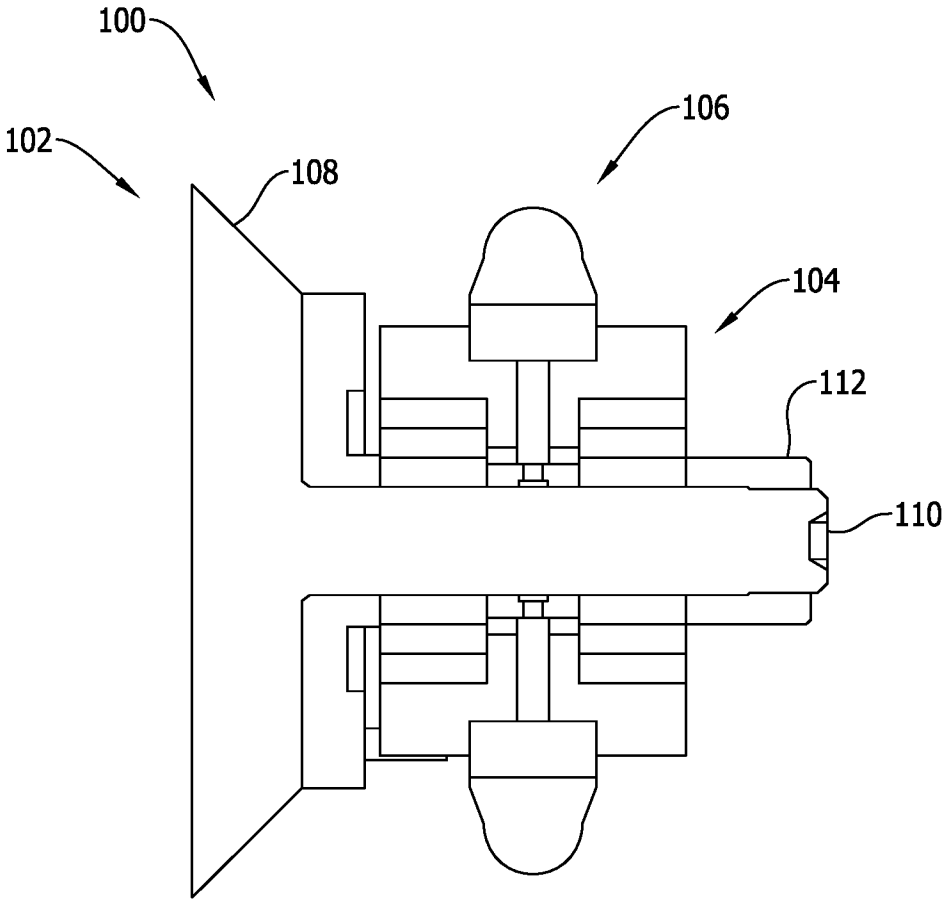
FIG. 2 is a cross-sectional view of the dressing assembly shown in FIG. 1 and taken along line 2-2 shown in FIG. 1.

FIG. 1 is a perspective view of an exemplary dressing assembly 100 (i.e., a first rotatable assembly), and FIG. 2 is a cross-sectional view of dressing assembly 100 taken along line 2-2 (shown in FIG. 1). In the exemplary embodiment, dressing assembly 100 includes an arbor 102, a gear and bearing system 104 coupled to arbor 102, and a grinding wheel 106 coupled to gear and bearing system 104. For example, arbor 102 includes a main body 108 and a mounting shaft 110 extending therefrom. In one embodiment, gear and bearing system 104 is preloaded on mounting shaft 110, and system 104 and grinding wheel 106 are installed on mounting shaft 110 using a one-shot bearing press (not shown). A retaining nut 112 coupled to mounting shaft 110 facilitates holding gear and bearing system 104 and grinding wheel 106 in position relative to mounting shaft 110. Arbor 102 also includes a threaded end 114 that is opposite from mounting shaft 110 relative to main body 108. Threaded end 114 enables dressing assembly 100 to be selectively mounted within, and removed from, different machines. In one embodiment, gear and bearing system 104 and grinding wheel 106 are removable from arbor 102 for mounting onto a groove grinding machine (not shown in FIGS. 1 and 2).

Figure 3:
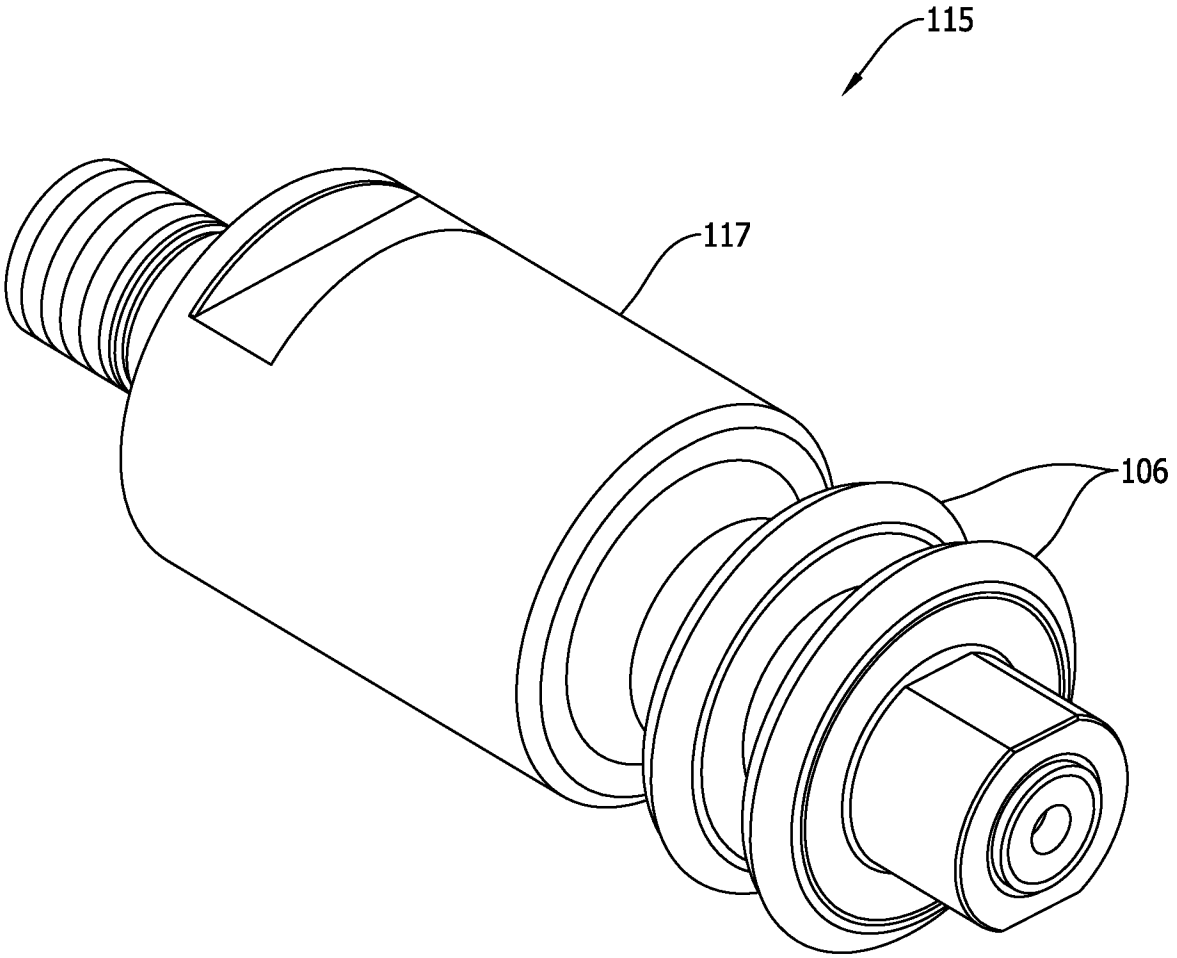
FIG. 3 is a perspective view of an exemplary grinding assembly.

FIG. 3 is a perspective view of an exemplary grinding assembly 115 (i.e., a second rotatable assembly). In the exemplary embodiment, grinding assembly 115 includes an arbor 117 and grinding wheels 106 coupled to arbor 117. Grinding wheels 106 are permanently affixed to arbor 117 during dressing on second grinding assembly 115, and during use of grinding assembly 115 to machine a workpiece. Thus, as will be explained in more detail below, grinding assembly 115 is capable of being mounted within, and removed from, different machines as a unitary and fully assembled structure.

Figure 4:
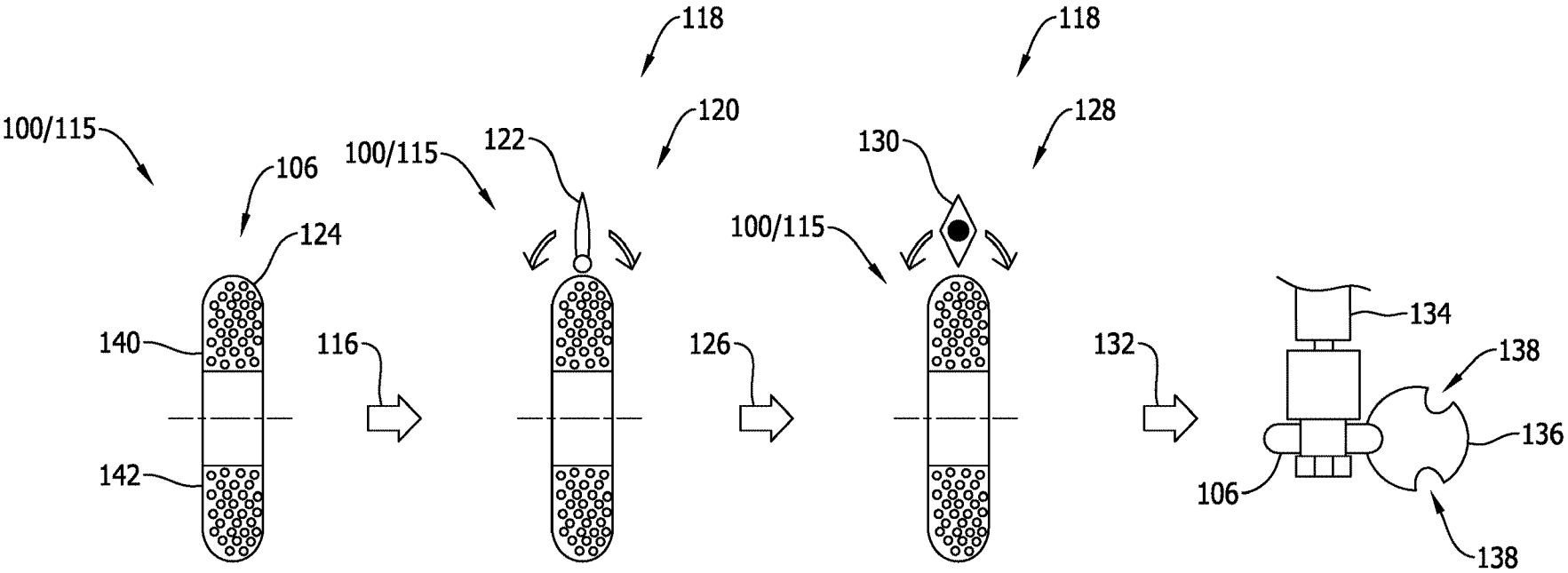
FIG. 4 illustrates a series of exemplary process steps for use in processing the dressing or grinding assemblies shown in FIGS. 1-3.

FIG. 4 illustrates a series of process steps for use in processing dressing or grinding assemblies 100 or 115. Although only grinding wheel 106 is illustrated in FIG. 4, it should be understood that, when processing assemblies 100 or 115, grinding wheel 106 is mounted within and removed from machines in the various process steps as a unitary and fully assembled structure (i.e., without removing grinding wheel 106 from arbors 102 and 117 (shown in FIGS. 1-3).

In the exemplary embodiment, a first process step 116 includes mounting assemblies 100 or 115 within at least one dressing machine 118. For example, dressing machine 118 may be, but is not limited to, a truing machine 120. Truing machine 120 includes a first dressing tool 122, such as an electrical discharge machining tool, and assemblies 100 or 115 are rotatable relative to first dressing tool 122 within truing machine 120 to facilitate shaping an outer surface 124 of grinding wheel 106 to define an intermediate outer profile. A second process step 126 includes removing assemblies 100 or 115 from truing machine 120 and mounting assemblies 100 or 115 within a conditioning machine 128 that includes a second dressing tool 130, such as a conditioning wheel. Assemblies 100 or 115 are rotatable relative to second dressing tool 130 to facilitate shaping outer surface 124 such that a final outer profile is defined, as will be explained in more detail below. In an alternative embodiment, truing and conditioning of grinding wheel 106 is performed in the same dressing machine 118 that includes both first dressing tool 122 and second dressing tool 130.

In the exemplary embodiment, a third process step 132 includes removing assemblies 100 or 115 from conditioning machine 128 and coupling grinding wheel 106 to a groove grinding machine 134. In one embodiment, gear and bearing system 104 and grinding wheel 106 are removed from arbor 102 (shown in FIG. 1), and then coupled to a belt-driven groove grinding machine. In an alternative embodiment, second grinding assembly 115 is removed from conditioning machine 128, and then mounted on a groove grinding head, as a unitary and fully assembled structure.

In operation, grinding wheel 106 is rotated by groove grinding machine 134 to enable a workpiece 136 to be machined. Thus, third process step 132 also includes machining a feature 138, such as a groove, into workpiece 136 with grinding wheel 106. As noted above, outer surface 124 of grinding wheel 106 has a final outer profile defined when processed by conditioning machine 128. More specifically, because the final outer profile is defined, feature 138 may be formed with a dimensional tolerance that is within a predefined range. The profile of outer surface 124 changes as material is abraded therefrom as machining processes are performed with grinding wheel 106. In the exemplary embodiment, the first and second process steps 116 and 126 may be repeated on assemblies 100 or 115 after grinding wheel 106 has been worn to a degree where it can no longer form feature 138 with a dimensional tolerance that is within the predefined range.

Grinding wheel 106 may be fabricated from any material, or in any manner, that enables assemblies 100 or 115 to function as described herein. For example, grinding wheel 106 may be fabricated in a manner that facilitates reconditioning and reuse of grinding wheel 106, as described above. For example, in the exemplary embodiment, grinding wheel 106 includes a ring-structure formed from a plurality of grit particles 140 dispersed within a metallic material 142. In one embodiment, grinding wheel 106 is fully formed from the combined mixture of grit particles 140 and metallic material 142. In an alternative embodiment, the combined mixture may be formed on a substrate such that only an outer radial portion of grinding wheel 106 is formed from the combined mixture. In such an embodiment, grit particles 140 are continuously exposed along outer surface 124 of grinding wheel 106 as outer surface 124 is abraded during use. In addition, dispersing grit particles 140 within metallic material 142 enables outer surface 124 to be reconditioned and re-shaped as necessary to enable the final outer profile to be redefined for use in machining workpiece 136. In one embodiment, grit particles 140 may include, but are not limited to, a cubic boron nitride material. Metallic material 142 may include, but is not limited to, a bronze alloy material.

Figure 5:
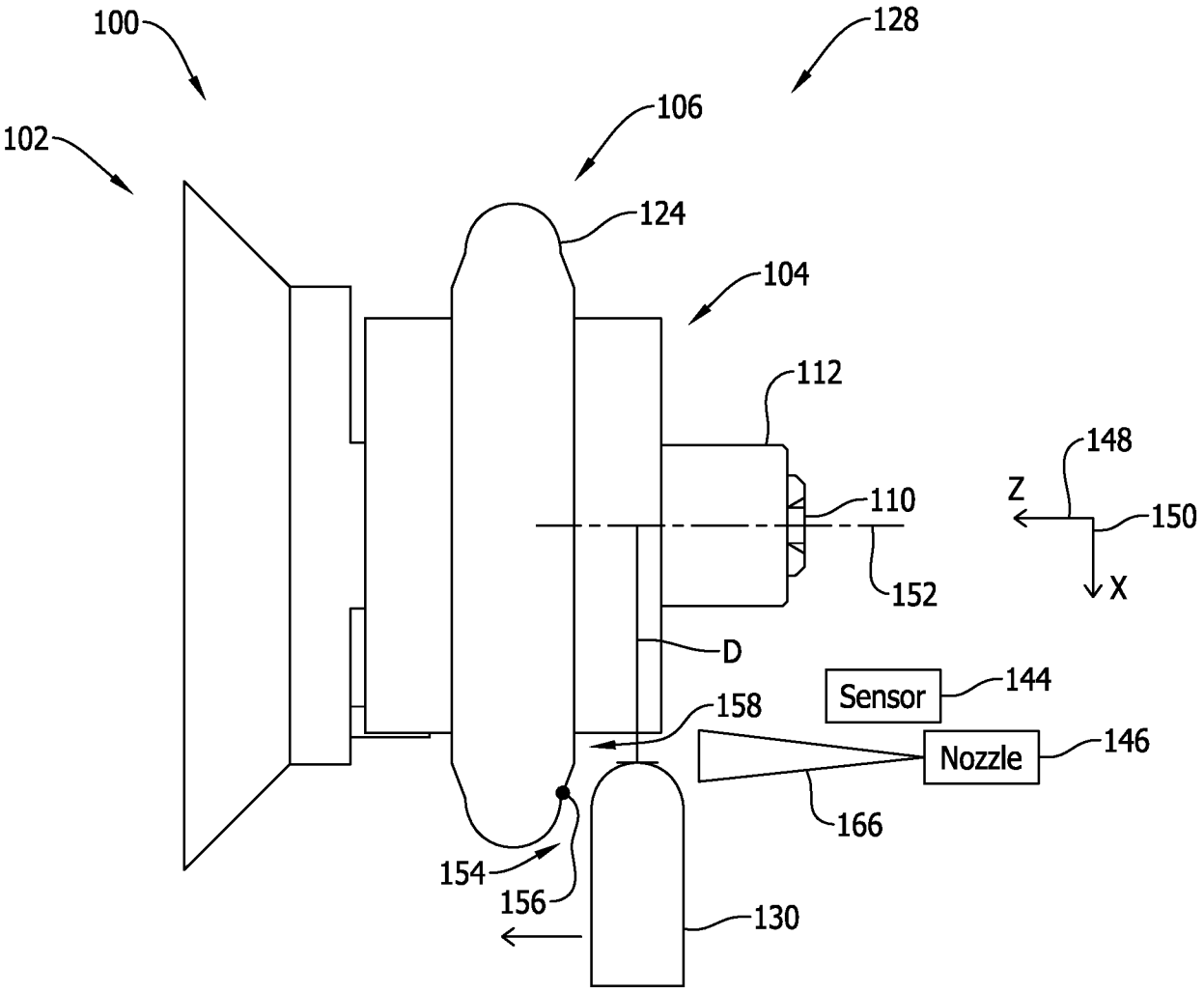
FIG. 5 illustrates an exemplary first process step for use in processing the dressing assembly shown in FIG. 1 and within a conditioning machine shown in FIG. 4.
Figure 6:
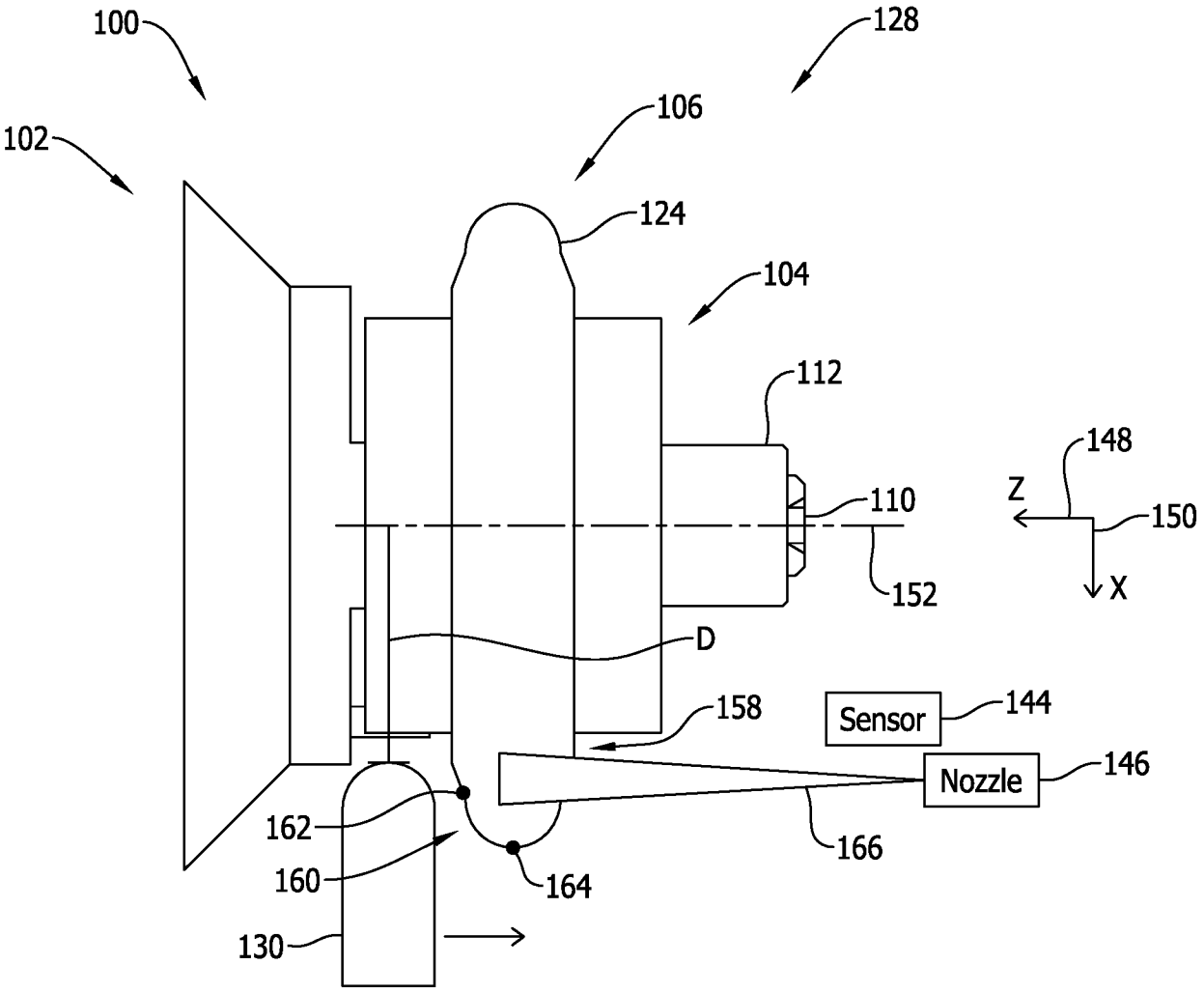
FIG. 6 illustrates an exemplary second process step for use in processing the dressing assembly shown in FIG. 4.

FIGS. 4 and 5 illustrate exemplary first and second process steps for use in processing dressing assembly 100 within conditioning machine 128 (shown in FIG. 3). Although illustrated as processing dressing assembly 100, it should be understood that the process steps described herein are also applicable to the processing of grinding assembly 115. The first and second process steps facilitate calibrating conditioning machine 128 such that a profile of grinding wheel 106 may be determined for planning further processing, as will be described in more detail below.

In the exemplary embodiment, referring to FIG. 4, conditioning machine 128 includes an acoustic sensor 144 and a nozzle 146. Dressing assembly 100 is mounted within conditioning machine 128, and a relative position of second dressing tool 130 is defined relative to a z-axis 148 and an x-axis 150. Z-axis 148 extends longitudinally relative to a longitudinal centerline 152 of grinding wheel 106, and x-axis 150 extends radially relative to longitudinal centerline 152. In operation, second dressing tool 130 is initially positioned a predefined radial distance D from longitudinal centerline 152 of grinding wheel 106 relative to x-axis 150. In addition, second dressing tool 130 is offset relative to grinding wheel 106 along z-axis 148 such that a gap 154 is defined between second dressing tool 130 and grinding wheel 106.

Second dressing tool 130 is then moved along z-axis 148 towards grinding wheel 106 to enable a first registration point 156 to be defined on a first side 158 of grinding wheel 106. For example, first registration point 156 is defined as a location between second dressing tool 130 and first side 158 of grinding wheel 106 where contact therebetween is first initiated. Referring to FIG. 5, the second process step includes moving second dressing tool 130 to a second side 160 of grinding wheel 106. Second dressing tool 130 is positioned at predefined radial distance D, and then moved along z-axis 148 towards grinding wheel 106 to enable a second registration point 162 to be defined on second side 160 of grinding wheel 106. A longitudinal center point 164 may then be determined on grinding wheel 106 based on first and second registration points 156 and 162. For example, with predefined radial distance D being constant for the positioning of second dressing tool 130 on both first and second sides 154 and 160 of grinding wheel 106, the longitudinal center point 164 can be determined by tracking the movement of second dressing tool 130 along z-axis 148 when first and second registration points 156 and 162 are defined. Outer surface 124 of grinding wheel 106 may then be shaped with second dressing tool 130 to define the final outer profile that is symmetric relative to longitudinal center point 164.

In some embodiments, grinding wheel 106 is used to machine a feature into a test coupon (not shown) before machining workpiece 136 (shown in FIG. 3). The test coupon may then be evaluated to determine if the feature has a dimensional tolerance within the predefined range.

In the exemplary embodiment, nozzle 146 channels a stream 166 of fluid between grinding wheel 106 and second dressing tool 130, and an acoustic sensor 144 is used to determine when contact is achieved between second dressing tool 130 and grinding wheel 106. For example, stream 166 of fluid facilitates providing an audible communication path between acoustic sensor 144 and the interface defined between second dressing tool 130 and grinding wheel 106. Positioning acoustic sensor 144 a distance from the interface enables conditioning machine 128 to compensate for the effects of thermal expansion, for example, in components within machine 128. When contact is achieved therebetween, an acoustic signal is transmitted through the audible communication path and received at acoustic sensor 144. Acoustic sensor 144 fine-tunes the acoustic signal to remove noise, and to select different frequency and decibel levels indicative of contact being achieved.

The embodiments described herein relate to systems and methods of processing a grinding wheel that facilitates reducing runout of a rotating assembly, that facilitates calibrating a dressing machine in a simplified and efficient manner, and that also enables the use of the grinding wheel fully formed from a mixture of grit particles and metallic material. The systems and methods described herein accomplish the aforementioned objectives by either installing a gear and bearing system and the grinding wheel on an arbor before performing the processing, or dressing the grinding wheel and using the grinding wheel to machine a workpiece all while mounted on the same arbor. In such an embodiment, the surface finish of the grinding wheel is enhanced and the grinding assembly is ready for immediate use after the conditioning process is complete.

Exemplary embodiments of dressing and grinding assemblies, and related methods of processing, are described above in detail. Although the systems herein described and illustrated in association with a rotatable grinding wheel, the invention is also intended for use with any rotatable machining tool. Moreover, it should also be noted that the components of the invention are not limited to the specific embodiments described herein, but rather, aspects of each component may be utilized independently and separately from other components and methods of assembly described herein.

This written description uses examples to disclose various embodiments, including the best mode, and also to enable any person skilled in the art to practice the various implementations, including making and using any devices or systems and performing any incorporated methods. The patentable scope of the disclosure is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal language of the claims.

What is claimed is:

1. A method of processing a rotatable assembly, the method comprising:

forming the rotatable assembly by:

mounting a gear and bearing system on an arbor; and mounting a grinding wheel on the gear and bearing system, wherein the grinding wheel has a ring-structure formed from a plurality of grit particles dispersed within a metallic material, wherein the arbor comprises a threaded end that enables the rotatable assembly to be selectively coupled to, and removed from, different machines;

removably mounting the rotatable assembly, via the threaded end, within at least one dressing machine such that the grinding wheel is rotatable relative to a dressing tool within the at least one dressing machine; and shaping the grinding wheel with the dressing tool to define a final outer profile of the grinding wheel configured to machine a workpiece.

2. The method in accordance with claim 1 further comprising: mounting the rotatable assembly within a truing and conditioning machine; and truing the grinding wheel mounted on the arbor.

3. The method in accordance with claim 2 further comprising conditioning, within the truing and conditioning machine, the grinding wheel mounted on the gear and bearing assembly.

4. The method in accordance with claim 1 further comprising: removing the rotatable assembly from the at least one dressing machine; and coupling the rotatable assembly to a groove grinding machine configured to machine the workpiece with the grinding wheel.

5. The method in accordance with claim 1 further comprising: removing the rotatable assembly from the at least one dressing machine; re-mounting the rotatable assembly within the at least one dressing machine; and reshaping the grinding wheel with the dressing tool to redefine the final outer profile.

6. The method in accordance with claim 1, wherein shaping the grinding wheel comprises defining the final outer profile configured to machine a feature into the workpiece, and configured to form the feature having a dimensional tolerance within a predefined range.

7. The method in accordance with claim 1, wherein shaping the grinding wheel comprises: moving the dressing tool towards the grinding wheel; and using an acoustic sensor to determine when contact is achieved between the dressing tool and the grinding wheel.

8. A method of processing a grinding wheel, the method comprising:

mounting a rotatable assembly including the grinding wheel within at least one dressing machine, wherein the grinding wheel includes a ring-structure, and wherein the rotatable assembly is rotatable relative to a dressing tool within the at least one dressing machine;

wherein the rotatable assembly further includes a gear and bearing system on an arbor, wherein the arbor comprises a threaded end that enables the rotatable assembly to be selectively coupled to, and removed from, different machines;

channeling a stream of fluid between the grinding wheel and the dressing tool;

calibrating the at least one dressing machine, wherein calibrating comprises:

positioning the dressing tool at a constant radial distance relative to a longitudinal centerline of the grinding wheel such that a gap is defined between the dressing tool and the grinding wheel;

moving the dressing tool longitudinally towards the grinding wheel while maintaining the constant radial distance; and using an acoustic sensor to determine, via an audible communication path provided by the stream of fluid, when contact is achieved between the dressing tool and the grinding wheel, thereby determining at least one registration point on the grinding wheel.

9. The method in accordance with claim 8, wherein the calibrating further comprises: determining a first registration point of the at least one registration point, on a first side of the grinding wheel; determining a second registration point on a second side of the grinding wheel; and determining a longitudinal center point on the grinding wheel based on the first and second registration points.

10. The method in accordance with claim 9 further comprising shaping the grinding wheel with the dressing tool to define a final outer profile that is symmetric relative to the longitudinal center point.

11. The method in accordance with claim 8 further comprising receiving, by the acoustic sensor, an acoustic signal through the audible communication path when contact between the dressing tool and the grinding wheel is achieved.

12. The method in accordance with claim 8 further comprising: machining a feature into a test coupon with the grinding wheel; and evaluating the test coupon to determine if the feature has a dimensional tolerance within a predefined range.

13. The method in accordance with claim 8 further comprising shaping the grinding wheel with the dressing tool to define a final outer profile of the grinding wheel configured to machine a workpiece.

14. A system for use in shaping a grinding wheel, the system comprising:

at least one dressing machine comprising a dressing tool; and a rotatable assembly removably mounted within the at least one dressing machine, the rotatable assembly comprising:

an arbor comprising a threaded end that enables the rotatable assembly to be selectively mounted within, and removed from, different machines;

a gear and bearing system coupled to the arbor; and a grinding wheel coupled to the gear and bearing system, wherein the grinding wheel includes a ring-structure formed from a plurality of grit particles dispersed within a metallic material.

15. The system in accordance with claim 14, wherein the plurality of grit particles are formed from a cubic boron nitride material.

16. The system in accordance with claim 14, wherein the grinding wheel is fully formed from a combined mixture of the plurality of grit particles and the metallic material.

17. The system in accordance with claim 14, wherein the rotatable assembly is selectively removable from the at least one dressing machine as a unitary structure.

* * * * *